United States Patent [19]

Sadler et al.

[11] 4,450,424

[45] May 22, 1984

[54] ELECTRICAL INSULATING SYSTEM

[75] Inventors: Fred S. Sadler, Jessup, Pa.; Paul F. Hettwer; Vu H. Viet, both of Franksville, Wis.; Clarence R. Acker, Zanesville, Ohio

[73] Assignee: McGraw-Edison Company, Rolling Meadows, Ill.

[21] Appl. No.: 376,525

[22] Filed: May 10, 1982

[51] Int. Cl.[3] ..... H01F 27/32; H01B 3/18

[52] U.S. Cl. ..... 336/94; 252/567; 252/575; 174/17 LF; 174/110 P; 162/138; 162/158; 336/206; 336/232

[58] Field of Search ..... 252/567, 575; 336/94; 174/17 LF, 110 P; 162/138, 158

[56] References Cited

U.S. PATENT DOCUMENTS

| | | | |
|---|---|---|---|
| 2,505,545 | 4/1950 | Hopkins et al. | 162/138 |
| 2,535,690 | 12/1950 | Miller et al. | 162/138 |
| 2,722,561 | 11/1955 | McCulloch | 252/575 |
| 3,102,159 | 8/1963 | Ford | 174/17 |
| 3,135,627 | 6/1964 | Sadler | 252/576 |
| 3,211,516 | 10/1965 | Sadler | 252/576 |
| 3,224,902 | 12/1965 | Sadler et al. | 252/576 |
| 3,429,819 | 2/1969 | Tierney | 252/567 |
| 3,617,438 | 11/1971 | Nakao et al. | 162/138 |

*Primary Examiner*—John E. Kittle
*Assistant Examiner*—Robert A. Wax
*Attorney, Agent, or Firm*—Jon C. Gealow; James A. Gabala; R. Jonathan Peters

[57] ABSTRACT

An insulating system is described that incorporates a cellulosic material which is impregnated with a nitrogen content no less than 0.2% by weight and a overall density not greater than 0.9 gm/cm$^3$. This cellulosic material when impregnated by a dielectric liquid such as transformer oil, exhibits a more uniform electrical stress distribution than papers having a density greater than 0.9 gm/cm$^3$. The insulating system thereformed is particularly useful for application in low stress areas such as the layer insulation in a distribution class transformer.

2 Claims, 1 Drawing Figure

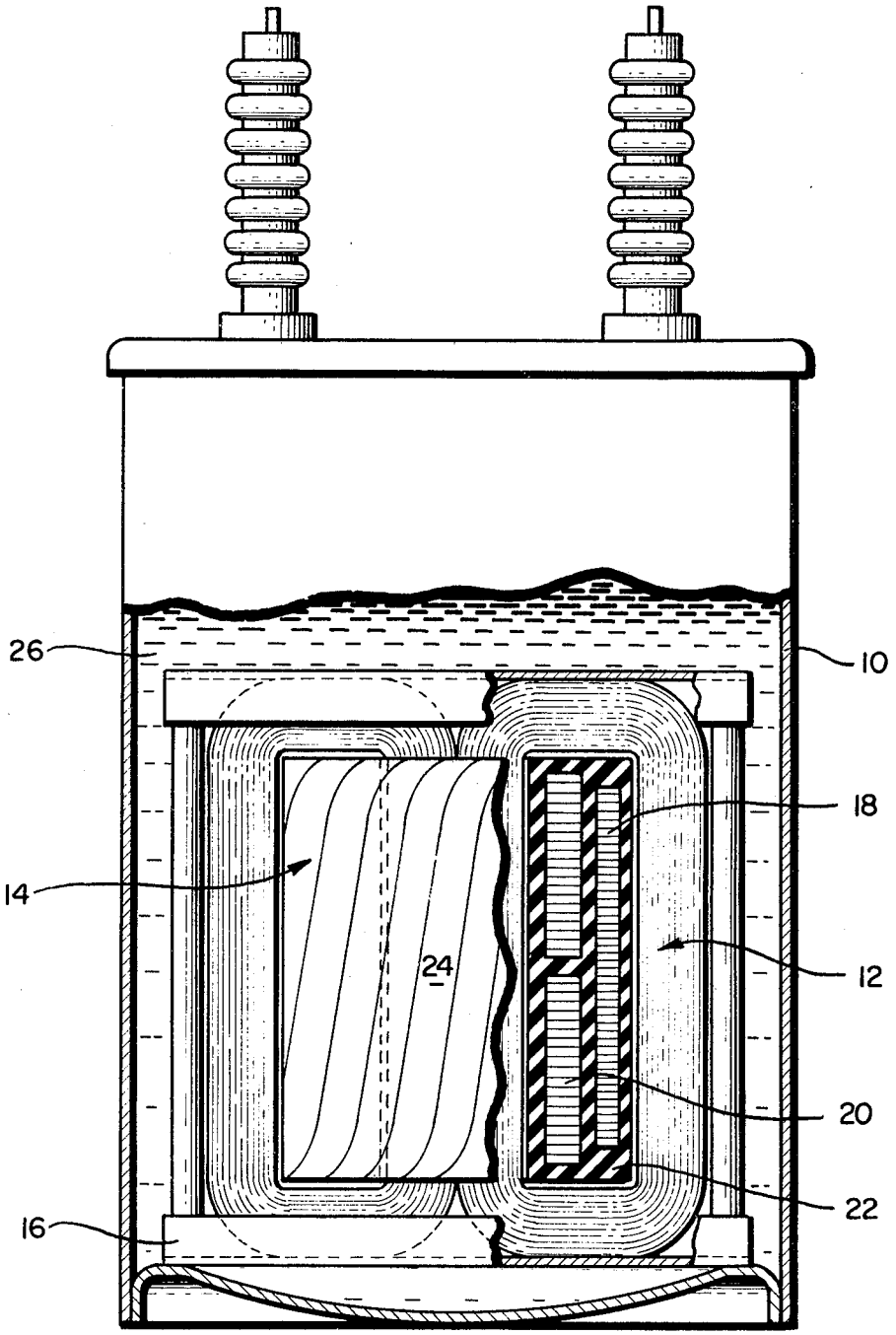
26
10
18
14
24
12
20
22
16

ELECTRICAL INSULATING SYSTEM

FIELD OF THE INVENTION

This invention relates to low density paper for use as insulating paper, and exhibiting improved distribution of electrical stress.

BACKGROUND OF THE INVENTION

Paper products formed from lignocellulose pulps are commonly employed as insulation for various electrical apparatus. Such products are particularly useful for this purpose because of their dielectric strength and their economic advantage. The paper may be used, for example, as dielectric spacers in capacitors or as insulating sheet for windings in a transformer. Typically the electrical apparatus, encased in an appropriate housing, is immersed in a liquid dielectric such as petroleum oil, waxes or chlorinated hydrocarbons.

Paper insulating materials used in electrical apparatus or subjected to elevated temperatures, and it has long been recognized that the insulating papers deteriorate rapidly in use. This deterioration still exists when the insulating papers are in contact with, or immersed in, a liquid dielectric such as transformer oils. The elevated temperatures may cause the liquid dielectric to break down into acids or other chemical constituents which attack or degrade the cellulose insulation material. As a consequence, the insulating paper gradually deteriorates thereby adversely affecting its electrical and mechanical properties. For this reason the paper is treated or impregnated with various materials or compounds to improve the electrical performance and stability of the paper.

A number of prior art patents disclose impregnating the paper with a nitrogen-donor compound or compounds in order to increase the nitrogen content of the paper thereby improving its insulating properties, especially thermal stability. Representative U.S. patents include U.S. Pat. No. 2,535,690 (impregnating the pulp with acrylonitrile); U.S. Pat. No. 3,102,159 (melamine and dicyandiamide added to the paper at the sizing tank); U.S. Pat. No. 3,469,219 (paper impregnated with a guanamine).

The prior art teachings, however, are all deficient in one or more respects. Most significant, the prior art and the accepted practice in the electrical industry utilize exclusively high density papers (i.e., papers having a density greater than 0.9 gm/cm$^3$, and typically 1.0 gm/cm$^3$ or greater). Low density paper inherently exhibits a low dielectric strength and therefore this is one factor that should prohibit its use as insulating paper. We have found, contrary to the prior art and industry practice, that low density paper can be treated to exhibit good properties thereby rendering it useful as electrical insulation.

This invention has as its purpose to provide paper cellulose material of low density exhibiting more uniform stress distribution. This together with other objects and advantages of the invention may be further understood by reference to the following detailed description and accompanying drawing of a view in elevation, partly broken, of a transformer utilizing insulating paper made in accordance with the present invention.

SUMMARY OF THE INVENTION

Broadly, this invention comprises an unique cellulosic material exhibiting a better or more uniform distribution of electrical stress. The cellulosic material having a low density, desirably in paper sheet or web form made from lignocellulose-pulps using Kraft process or other processes such as sulfite, is treated or impregnated with a nitrogen-donor compound or compounds in order to incorporate not less than 0.2% by weight nitrogen into the cellulose material, said weight based on the dry weight of the paper. The nitrogen-donor serves as a thermal stabilizer, and insulating paper treated with such a compound can better withstand degradation or deterioration when subjected to electrical and thermal stresses.

For purposes of this invention the paper has a low density, i.e., not greater than 0.9 gm/cm$^3$, which use is contrary to the teachings of the prior art and accepted practice in the paper insulating industry. Under the most desirable circumstances, the paper should have the highest mechanical strength possible, the highest dielectric strength possible, and the lowest density possible. This balance in properties is exceedingly difficult to achieve because emphasizing one property will mean a sacrifice in another. When paper utilized as insulation is immersed in a liquid dielectric (e.g., transformer oil), the dielectric constant for the composite is different from that of each of the components and is likely to be different for low density paper than for high density paper. The dielectric constant for high density paper is expected to be higher than that of low density paper. However, the liquid dielectric which impregnates the paper serves to distribute the dielectric stress. It is essential, therefore, to fill substantially all of the voids or interstices of the paper web with the liquid because a void is a potential weak spot. We have found that low density paper treated by our invention is more readily impregnable with the liquid dielectric because the voids are more readily filled and the weak spots substantially eliminated. Therefore the dielectric stress in a low density paper is more evenly distributed. Thus such paper exhibits improved dielectric integrity.

Papers formed by this invention are particularly suitable for use as electrical insulation such as for distribution transformers.

BRIEF DESCRIPTION OF THE DRAWINGS

The drawing is a cross-sectional side elevational view of a distribution class transformer having an insulation system that is the subject of the present invention.

DETAILED DESCRIPTION AND PREFERRED EMBODIMENTS

In accordance with this invention, cellulose material to be treated may be formed from any of a variety of starting materials as the base stock. Cellulose material preferably is formed as a continuous web or sheet by a conventional paper making process, such as by cylinder or Fourdrinier methods, which process, per se, forms no part of this invention. It is understood that the term "cellulose material" as used in this specification and in the appended claims is intended to include paper containing material fibers, synthetic fibers, or blends thereof, provided they do not adversely affect the physical or electrical properties of the end product. Paper of the Kraft variety is commonly employed in the electrical industry as insulating paper and is particularly suitable for the present invention, but it is understood that other paper, such as sulfite varieties, are also applicable.

In the conventional paper making process, pulp slurry in the beater is passed to the paper machine for forming a continuous web. The wet web leaving the machine is dewatered by conventional techniques such as with vacuum, presses and/or dryers. The moisture content of the cellulosic web is reduced to about 10% by weight dry basis, or less, and preferably to about 5%. For purposes of this invention, the cellulosic web has a density not greater than about 0.9 gm/cm$^3$, and preferably not greater than about 0.8 gm/cm$^3$.

The dried web of low density is treated or impregnated with one or more nitrogen-donor compounds at the size press. Among such nitrogen-donor compounds are dicyandiamide, acrylonitrile, dimethyl formamide, melamine, a cyclic diamine such as piperazine, and the like. Dicyandiamide is the preferred compound because it is a particularly good nitrogen-donor to cellulose and therefore a good thermal stabilizer, it is readily available and it is economical. A solution or emulsion of the compound may be applied to the web as spraying, brushing, dipping, etc. and preferably by size press addition in the conventional manner. The nitrogen-donor compound should be allowed to penetrate deep into the paper and be substantially uniformly distributed throughout the paper. In this manner the nitrogen content of the paper is increased to at least about 0.2% by weight on a dry weight basis, and preferably not less than 0.5% by weight. The amount of nitrogen incorporated into the paper web at this step, or the amount required, will depend largely upon the thermal stability required, the chemical compound used, and the end use application. Generally there is no need to add more than about 4 weight percent nitrogen because no increased benefit is achieved or noticeable with increased amounts and because it is not economical to add more. The paper web is then appropriately dried by conventional means to evaporate the solvent and to a moisture content not greater than about 10 weight percent.

When desired, the paper web may be treated or impregnated with a further addition such as vegetable protein soluble in an alkaline solution. Such protein includes, for example, a soybean protein, vegetable casein, alpha protein, cereal flours, and the like. A particularly suitable protein is protein isolated from soybeans, which is readily available and relatively inexpensive. The amount of protein incorporated into the paper from such solutions will depend largely upon the dielectric strength required and the end use application. Here, too, the protein solution may be applied by conventional means such as brushing or spraying, but preferably by size press addition. The paper is then dried by conventional means, or as in the laboratory on a weighted press dryer, to produce a treated paper which is essentially wrinkle free.

In order to more fully describe the benefits and advantages obtained by practicing this invention, the following examples are given by way of illustration and not be way of limitation. The examples illustrate the improved results obtained in using the treated cellulose insulation material in electrical apparatus. It will be noted that the accelerated aging tests were conducted under conditions which were intended to simulate in so far as possible the conditions to which cellulose insulating materials are subjected during normal operation of an oil filled transformer.

In preparing each of the samples, electrical grade Kraft paper 5 mils thick and having a density of 0.79 gm/cm$^3$ (as determined by ASTM D202-72a Wet Basis) was treated with a 3 weight percent solution of dicyandiamide by size press addition. The paper was dried at 125° F. for approximately 20–25 minutes. The paper contained 3.75% nitrogen as determined by the Kjeldahl method. The paper was then cut to sample sheets measuring 8½ inches by 11 inches. All samples were equilibrated prior to testing at 50% relative humidity and 73° F. for 48 hours.

Some sample sheets were tested for physical properties. Other sample sheets were subjected to an accelerated aging tests by aging in Texaco 55 transformer oil at 170° C. for 5 days. The aging test is described by B. D. Brummet in *Insulation,* pp. 35–37, August 1964. According to this procedure, paper is wrapped around a copper strip measuring 12"×½"×1 mil. This is held by a copper wire and placed in a container, sealed and a vacuum pulled. The temperature is raised to 105° C. and held there for 16 hours to remove the moisture from the paper. Transformer oil, which had been predried to 15 ppm moisture, was then added to the container to impregnate the paper. A blanket of dry air is maintained above the oil at 1 psi, and then heated to 170° C. and held there for 5 days. The paper was removed and tested. The results of all tests are set forth in the following table.

TABLE

Properties of Treated Paper

| Properties | MD/CD[1] | | Test Procedure MD/CD |
|---|---|---|---|
| Breakdown Strength volts/mil | 156 | | ASTM D149-75 |
| Tensile Load lbs /in. | 47/21 | | TAPPI T404-OS76 |
| Burst (lb/in$^2$) | 67 | | TAPPI T403-OS76 |
| Fold Endurance double-fold | 652/305 | | TAPPI T511-SU69 |
| Apparent Density g/cm$^3$ | 0.79 | | TAPPI UM444 TAPPI T411-ts65 |
| Aging Tests | B.A[2] | A.A[3] | |
| Breakdown Strength volts/mil | 646 | 1146 | ASTM D149-75 |
| Tensile Strength lbs/in. | 47 | 56 | TAPPI T404-OS76 |
| Burst Strength (lb/in$^2$) | 59 | 48 | TAPPI T403-OS76 |

Notes
[1]Machine direction/cross direction MD/CD
[2]Before aging (machine direction) B.A.
[3]After aging (machine direction) A.A.

It was observed that the paper of this invention, although of low density, is a well-bonded sheet, and exhibits good physical and electrical properties. The low density paper of this invention is particularly useful for low stress areas such as for layer insulation in a distribution transformer.

A transformer embodying cellulose insulation made in accordance with this invention is shown in the drawing. The transformer is encased within a tank 10 and consists essentially of a magnetic core 12 and a coil 14, both of which are supported in spaced relation from the bottom of tank 10 by channel support members 16 or the like. The coil 14 comprises a high voltage winding 18 and a low voltage winding 20 which are insulated from one another by the treated cellulose insulation 22. A treated cellulose wrapping 24 may also be applied to the exterior of the coil 14. A liquid dielectric 26 comprising oil, chlorinated diphenyl or the like is disposed within the tank 10 to cover the core 12 and the coil 14 in order to insulate them and to dissipate the heat generated during operation.

Although certain embodiments of the invention have been illustrated and described, many modifications and variations thereof will be obvious to those skilled in the art, and consequently it is intended in the appended claims to cover all such modifications and variations which fall within the true spirit and scope of the invention.

We claim:

1. A distribution-class transformer, comprising:

a container, a plurality of sheet-like electrical conductors wound in a transforming relationship and disposed in said container, a liquid dielectric within the container surrounding said electrical conductors, and kraft paper having an initial density of approximately 0.80 gm/cm$^3$ and a generally uniform nitrogen content of approximately 4% by weight achieved through impregnation with dicyandiamide, said paper being applied as layer insulation between said conductors and impregnated with said liquid dielectric, whereby the voltage stress distribution within said kraft paper is more uniformly distributed relative to a kraft paper having an initial density of approximately 0.80 gm/cm$^3$ and not so treated with dicyandiamide.

2. The distribution-class transformer of claim 1, wherein said liquid dielectric is transformer oil.

* * * * *